US006533394B1

(12) United States Patent
Trunk et al.

(10) Patent No.: US 6,533,394 B1
(45) Date of Patent: Mar. 18, 2003

(54) ORIFICE PLATE WITH BREAK TABS AND METHOD OF MANUFACTURING

(75) Inventors: Gerald G Trunk, Monmouth, OR (US); Angela W Bakkom, Corvallis, OR (US); Niranjan Thirukkovalur, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/942,477

(22) Filed: Aug. 29, 2001

(51) Int. Cl.[7] ..... B41J 2/16; B41J 2/135
(52) U.S. Cl. ..... 347/47; 29/890.1
(58) Field of Search ..... 347/40, 44, 45, 347/49, 47; 29/890.1

(56) References Cited

U.S. PATENT DOCUMENTS

| | | | | | |
|---|---|---|---|---|---|
| 5,194,877 | A | * | 3/1993 | Lam et al. | 347/45 |
| 5,236,572 | A | * | 8/1993 | Lam et al. | 347/45 |
| 5,255,017 | A | * | 10/1993 | Lam et al. | 347/45 |
| 5,900,892 | A | * | 5/1999 | Mantell et al. | 347/45 |
| 6,109,728 | A | * | 8/2000 | Kakuda et al. | 347/45 |
| 6,312,120 | B1 | * | 11/2001 | Ando et al. | 347/40 |

* cited by examiner

*Primary Examiner*—Huan Tran
(74) *Attorney, Agent, or Firm*—Lucinda G. Price

(57) ABSTRACT

An orifice plate of a fluid ejection device comprises a rectangular plate body having an edge and a plurality of nozzle arrays, wherein the edge has a pair of recesses therealong, and a break tab in between the pair of recesses along the edge.

15 Claims, 5 Drawing Sheets

ORIFICE PLATE WITH BREAK TABS AND METHOD OF MANUFACTURING

FIELD OF THE INVENTION

This invention relates to ink jet printers, and particularly manufacture of orifice plates for use with ink jet printers and assembly therewith.

BACKGROUND

Generally, thermal ink jet printers have a print cartridge. The print cartridge often includes a print head having an orifice plate defining one or more arrays of numerous orifices through which droplets of fluid are expelled onto a medium to generate a desired pattern.

Orifice plates are often manufactured in sheets, and separated by streets or gaps in the orifice plates. Along the streets are break tabs that couple adjacent orifice plates. The amount of orifice plates in each sheet is directly affected by the width of the streets. It is desired to minimize the size of the street width and thereby minimize the material cost per individual orifice plate.

The orifice plate has a core plate material that is typically formed of a metal. The orifice plates are separated through a singulation process along the break tabs. Typically, an area of the core plate material at the break tab is exposed during this process. Often, the metals forming the core plate material are susceptible to corrosion by some fluids used in the cartridges. The exposed metal in the orifice plate sometimes forms a galvanic cell with some of the fluids used in the cartridge. With corrosion or the formation of a galvanic cell with the orifice plate, the cartridge is more likely to be rendered inoperable prematurely.

Often the exposed areas of the plate are encapsulated with an inert coating. However, the coating often extends over the plate to at least partially block the orifices through which fluid is to be expelled in a printing process. Consequently, an adequate margin between the orifices and exposed areas is employed. The size of the print head die onto which the plate is attached is thereby directly affected. It is desired to minimize the size of the print head die due to the costs associated with the material used therein. Accordingly, it is desired to manufacture orifice plates that minimize print head die size, minimize material costs, resist corrosion and minimize galvanic cell formation.

SUMMARY

An orifice plate of a fluid ejection device comprises a rectangular plate body having an edge and a plurality of nozzle arrays, wherein the edge has a pair of recesses therealong, and a break tab in between the pair of recesses along the edge.

Many of the attendant features of this invention will be more readily appreciated as the same becomes better understood by reference to the following detailed description and considered in connection with the accompanying drawings in which like reference symbols designate like parts throughout.

DETAILED DESCRIPTION

Figure 1:
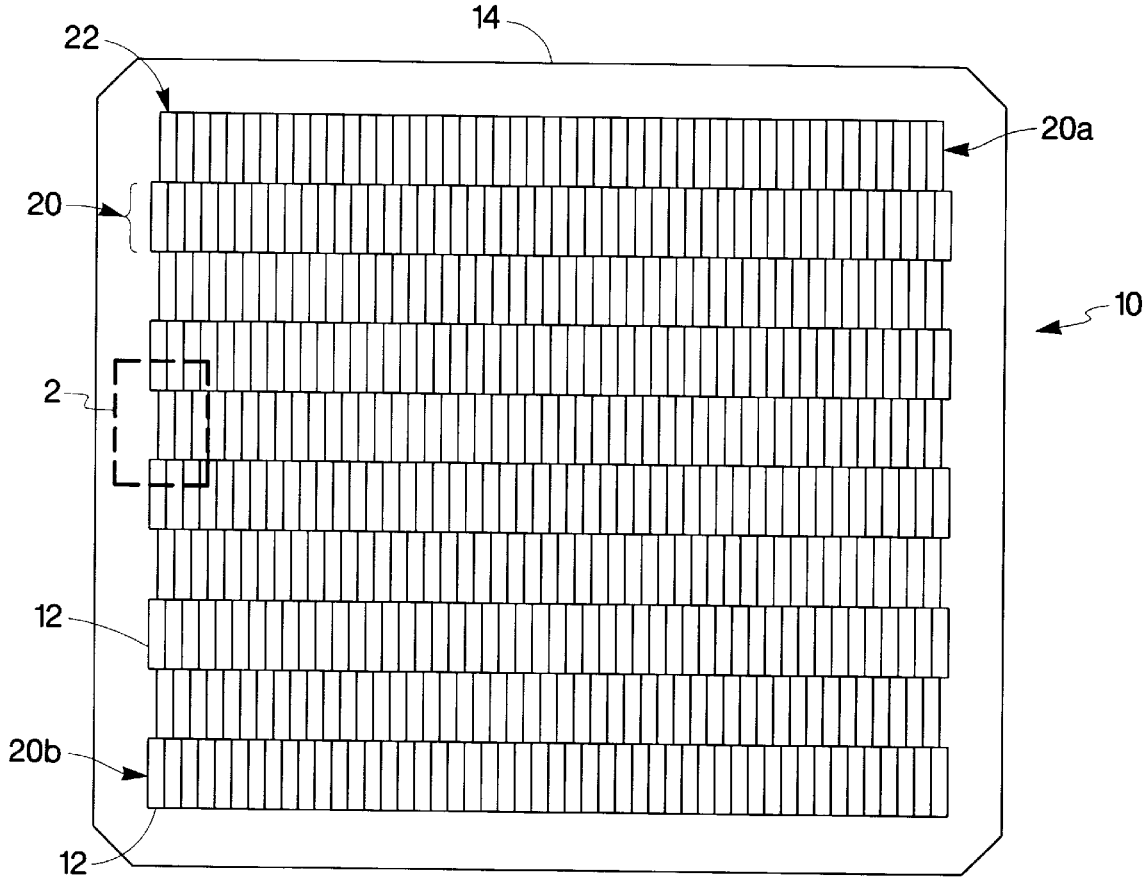
FIG. 1 is a plan view of a sheet of intercoupled orifice plates according to one embodiment of the invention.

In the embodiment shown in FIG. 1, a sheet 10 has a multitude of intercoupled orifice plates 12. The sheet includes a peripheral frame 14 that surrounds the plates, and that provides structural support of the sheet, as well as alignment of the plates.

In the embodiment shown, the sheet 10 is a square. The sheet has side lengths in a range of about 150 to 500 mm. In other embodiments the sheet length and width are different and may be determined by a desired number of plates per sheet, and/or a desire to have a sheet size that is compatible with manufacturing equipment sizes.

In this embodiment, the frame 14 has a width of approximately 20 mm around the sides of the sheet. In alternative embodiments, the frame has a width that is found in a range from about 10 to 100 mm. In one embodiment, the frame size is determined based on the desired level of sheet structural integrity and stiffness.

The plates 12 are arranged in rows 20 and columns 22. In the embodiment of FIG. 1, there are more columns than rows. In the embodiment shown, the rows 20 are staggered, in that the plates of one row are offset from the plates of the adjacent rows. In this embodiment, the offset is about one half the center-to-center spacing of the plates.

Each plate 12 is substantially identical to the other plates in the sheet 10 in the embodiment illustrated. In alternative embodiments (not shown), the sheet has different plate designs. In one embodiment, each plate is an elongated rectangle having a width of about 2.7 mm and a length of about 10.6 mm. In another embodiment, the width of the plate is found in a range of from about 2 to 10 mm, and the length is found in a range from about 5 to 20 mm. In another embodiment, the length and width of the plate depends on the demands of the application, including desired swath height, number of orifice arrays, and resolution. In one embodiment, the plate has an aspect ratio of about 4:1. In another embodiment, the aspect ratio is found in a range of from about 1:1 up to 8:1, for longer orifice arrays.

In the embodiment illustrated, the sheet of plates has a core plate material (not shown). In this embodiment, the core plate material is nickel. The core plate material is plated with a plating material 80 or a protective material (shown in FIG. 5, and described in more detail below). The sheet of plates has opposing surfaces which are plated with the plating material 80.

In this embodiment, the core plate material is formed by plating over a substrate. In one embodiment, the substrate is glass, and in another embodiment, the substrate is metal. In a first embodiment, the core plate material is peeled from the substrate and dipped into an electroplating bath to coat with the plating material. In a second embodiment, the core plate material is plated with a combination of nickel and the plating material 80. In one embodiment, the plating material 80 is corrosion resistant. In a more specific embodiment, the plating material 80 is gold or another precious metal, such as palladium. In another embodiment, the amount of precious metal is minimized, while plating reliability is maintained. In the second embodiment, where the plating material is gold, or another precious metal, the core plate material would be plated with Ni—Rh, Ni—Pd, or Ni—Au.

These sheets of plates are generally 15 to 55 μm (or microns) thick. In the embodiment illustrated, the core plate material is nickel with a thickness of about 27 μm, and is coated with palladium having a thickness of about 1.5 μm. In this embodiment, a sheet thickness (and thus orifice plate 12 thickness) is about 29 μm. In alternative embodiments, the nickel plating ranges between about 13 to 53 μm, and the palladium thickness ranges between 0.3 to 2.0 μm.

Figure 2:
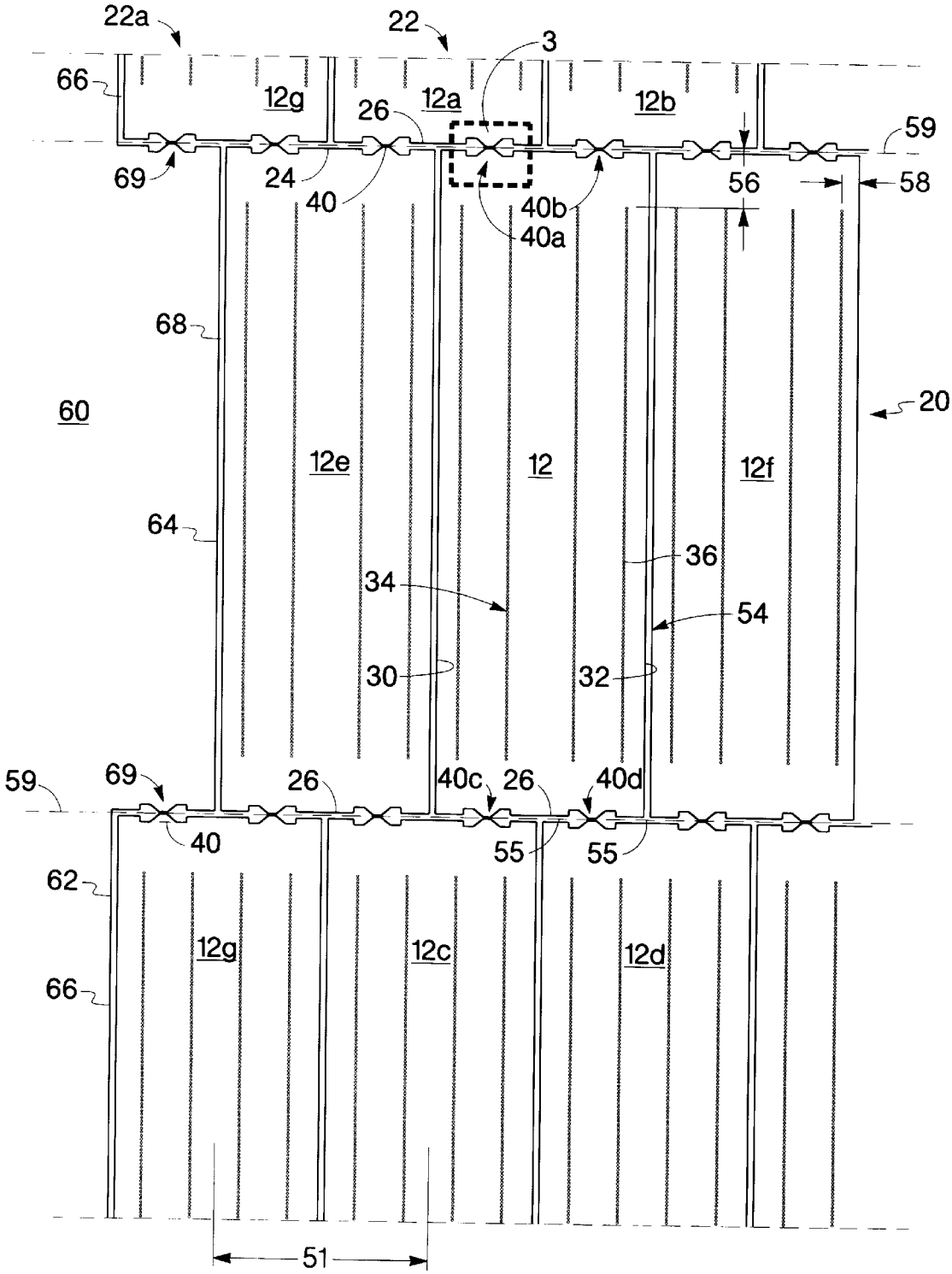
FIG. 2 is an enlarged view of section 2 of FIG. 1.

FIG. 2 is an enlarged view of section 2 of FIG. 1. FIG. 2 shows a partial view of the sheet having the orifice plates 12, 12*a*, 12*b*, etc. with break tabs 40 and streets 54 therebetween. Each plate has opposed first and second end edges 24, 26, and opposed first and second side edges 30, 32. In this embodiment, the plates, break tabs 40, and streets 54 are formed during the process of forming the core plate material, and before the core plate material is protected with the plating material 80. Accordingly, the break tabs 40, end edges 24, 26, and side edges 30, 32 are plated with the plating material 80.

As shown in the embodiment of FIG. 2, each orifice plate includes four arrays 34 of nozzles/orifices 36. In one embodiment, each of the four nozzle arrays corresponds to a different color that is supplied from a fluid reservoir or fluid container in a printer cartridge. In an alternative embodiment, the number of arrays in the plate range from about 1–12. In another embodiment, at least two of the nozzle arrays correspond to a same color.

In one embodiment, the nozzle arrays 34 are in a rectangular zone. As shown in FIG. 2, the orifice plates have an end peripheral zone 56 from each end edge 24, 26 to the rectangular zone of the arrays 34. The plates have an side peripheral zone 58 from each side edge 30, 32 to the rectangular zone of the arrays 34. The end peripheral zone is about 982 μm wide. The side peripheral zone 58 is about 165μm wide. In alternative embodiments, the values of the width of the end and side zones 56, 58 range from between about 800 to 1000 μm, and from between about 100 to 800 μm, respectively. With the narrow elongated plate shape, the end zones 56 are relatively small compared with the total plate area. The end zones 56 are intended to provide adequate margin for encapsulation of exposed broken end surfaces of the break tabs, as discussed in more detail below. In between the end zones 56 is a middle zone, and in the middle zone is the rectangular array of orifices.

As shown in FIG. 2, each plate is coupled with another plate on the sheet 10 using at least one break tab 40 along end edges 24, 26. The break tabs of the plates in one row are aligned with the break tabs of the plates in the adjacent rows. Each row of plates are offset from adjacent rows of plates a distance that is equal to a distance between adjacent break tabs. In this manner, the break tabs of one row 20 align with the break tabs in the adjacent rows, even though the plates themselves do not align in the columns 22. For each break tab in the plate along the edge 24, there is a corresponding break tab along the edge 26 of the plate in the adjacent, corresponding row. And for each break tab along the edge 26, there is a corresponding break tab along the edge 24 of the plate in the adjacent, corresponding row. The corresponding break tabs 40 of the adjacent plates are coupled with each other, thereby coupling the adjacent plates in the sheet.

In the embodiment illustrated in FIG. 2, there are four break tabs 40*a*, 40*b*, 40*c*, 40*d* for coupling the plate 12 to adjacent plates. The break tabs 40*a*, 40*b* are along the end edge 24 of the plate, while the break tabs 40*c* and 40*d* are along the end edge 26 of the plate. The break tabs 40*a* and 40*b*, and the break tabs 40*c* and 40*d*, are spaced apart from each other along the end edges 24 and 26, respectively.

As shown in FIG. 2, the break tabs 40*a*, 40*b*, 40*c*, and 40*d* couple the plate 12 with the plates 12*a*, 12*b*, 12*c* and 12*d*, respectively. The plates 12*a* and 12*b* are in the adjacent row above the plate 12, while the plates 12*c* and 12*d* are in the adjacent row below the plate 12.

In one embodiment, adjacent plates in a common row are indirectly coupled through plates in adjacent rows. In particular the plate 12 is indirectly coupled with plates 12*e*, 12*f* that are in the same row as the plate 12. The plate 12*e* is coupled with the plate 12 through either the plate 12*a* or the plate 12*c*. The plate 12*f* is coupled with the plate 12 through either the plate 12*b* or the plate 12*d*.

In the embodiment shown, the side edges 30, 32 of each plate are substantially straight, and do not include break tabs. This embodiment with no break tabs on the side edges enables the plates in the same rows to be fabricated in closer proximity, which in turn provides the economic advantage of more plates per sheet. In one embodiment, the gap or street 54 between the plates adjacent in the same row is between about 60 and 120 μm (or microns). In another embodiment, the gap 54 between the adjacent plates is about 80 to 100 μm.

Adjacent plates 12 that are in the same row 20 are spaced apart by the I-shaped elongated gap (or street) 54 that extends the length of the plate. Flanges of the I-shaped gap are end segments 55 formed substantially perpendicular to a main web portion of the gap 54. The gap 54 terminates at each end segment 55 by abutting the break tabs of the adjacent plates. The end segment 55 has a length determined by the distance between break tabs of adjacent plates. In another embodiment, a length of the gap 54 corresponds to the longest span of unsupported plate material. In another embodiment, the gap width is minimized to allow more plates per sheet. A width of the gap 54, including end segment 55, is less than about 120 μm between adjacent plates and adjacent rows. In alternative embodiments, the gap width ranges from about 20 to 110 μm. In another embodiment, the width of street 54 is about 60 to 110 μm.

In one embodiment, the break tabs are spaced apart evenly on the sheet at about half a pitch 51 of the plates. The pitch 51 is the distance between a center line of one plate to a centerline of an adjacent plate. The even spacing of the break tabs permits the stagger amount of about one-half the pitch between rows. In one embodiment, the break tab spacing on each plate is only slightly more than half the width of the plate.

As shown in FIG. 2, the sheet has an end column 22*a* of plates adjacent a frame portion 60 of the frame 14. In the embodiment shown in FIG. 2, the rows 20 of the plates in the sheet are staggered thereby rendering a corrugated shape to an outer edge of the end column 22*a*. Along the end column are exterior end plates 12*g* and interior end plates (shown in this embodiment as 12*e*). The plates in the end column alternate between the exterior end plate 12*g* and the interior end plate 12*e*. In the embodiment shown, the exterior end plates 12*g* extend about half the width of a plate past the interior end plates 12*e* into the frame portion 60.

The frame portion 60 has an interior boundary 62. The interior boundary 62 corresponds with the end column 22*a* of the sheet of plates such that there is a substantially consistently sized gap (or street) 68 in between the outer edge of the end column 22*a* and the interior boundary 62. In the embodiment shown in FIG. 2, the gap 68 has the same width as the gap 54. Accordingly, the interior boundary 62 is shaped in a corrugated shape opposite to the corrugated shape of the end column 22*a* of FIG. 2.

The interior boundary 62 has protruding portions 64 that correspond to the interior end plate 12*e,* and thus the protruding portions 64 have substantially the same length as the plates. Likewise, the interior boundary 62 has indented portions 66 that correspond to the exterior end plate 12*g*. The indented portions 66 receive the adjacent exterior end plate 12*g* in the staggered configuration. The protruding portions 64 are received into the area between adjacent exterior end plates 12*g* and the interior end plate 12*e*.

As shown in FIG. 2, the sheet of plates is attached to the frame in the same manner as the plates are coupled to their adjacent plates. The protruding portions 64 each have two break tabs 69 along edges adjacent to the exterior end plates 12*g*. Each break tab 69 couples with the corresponding break tab 40 of the exterior end plate 12*g,* as shown in FIG. 2. A top row 20*a* and a bottom row 20*b* of plates (shown in FIG. 1) are coupled to the frame through the break tabs 40 along the top end edges 24 and bottom end edges 26 of the plates in the top and bottom rows 20*a,* 20*b,* respectively. In one embodiment, the interior boundary 62 adjacent the top and bottom sides has break tabs (not shown) that correspond to the break tabs 40 of the plates 12 of the top and bottom rows 20*a,* 20*b*.

In the embodiment shown in FIG. 2, the break tabs are aligned along cut lines (or break lines or break areas) 59. The break areas 59 are substantially straight, parallel gaps that define divisions between rows. The plates in the sheet are separated from each other upon separation of the break tabs at the break areas. In this embodiment, singulation of the plates is enabled by substantially parallel and straight cuts along the break lines, as will be discussed below.

In the embodiment shown, each break tab 40 has a shape of a trapezoid. At a junction of the break tabs from adjacent plates, there is a cross-sectional area that is narrower than other areas of the break tabs. The narrower areas maximize the likelihood that a fracture occurs at the junction and away from the end edges 24, 26 of the plates. In alternative embodiments, the break tab is of another shape having a necked configuration, or may alternatively have a straight-sided rectangular bridge to the adjacent plate. In plate material. The rest of the plate 12 remains plated, while the end surfaces are exposed. As shown in this embodiment, after the plates are separated, the end surface 44 substantially aligns with the edge 24 of the plate body.

In the embodiment shown, the singulating process uses laser cutting of the break tabs along the break lines/end surfaces. In one embodiment, the singulation of the plates in the sheet is accomplished by other methods, as discussed in U.S. application Ser. No. 09/849,024 filed May 4, 2001, such as mechanical means.

Figure 4:
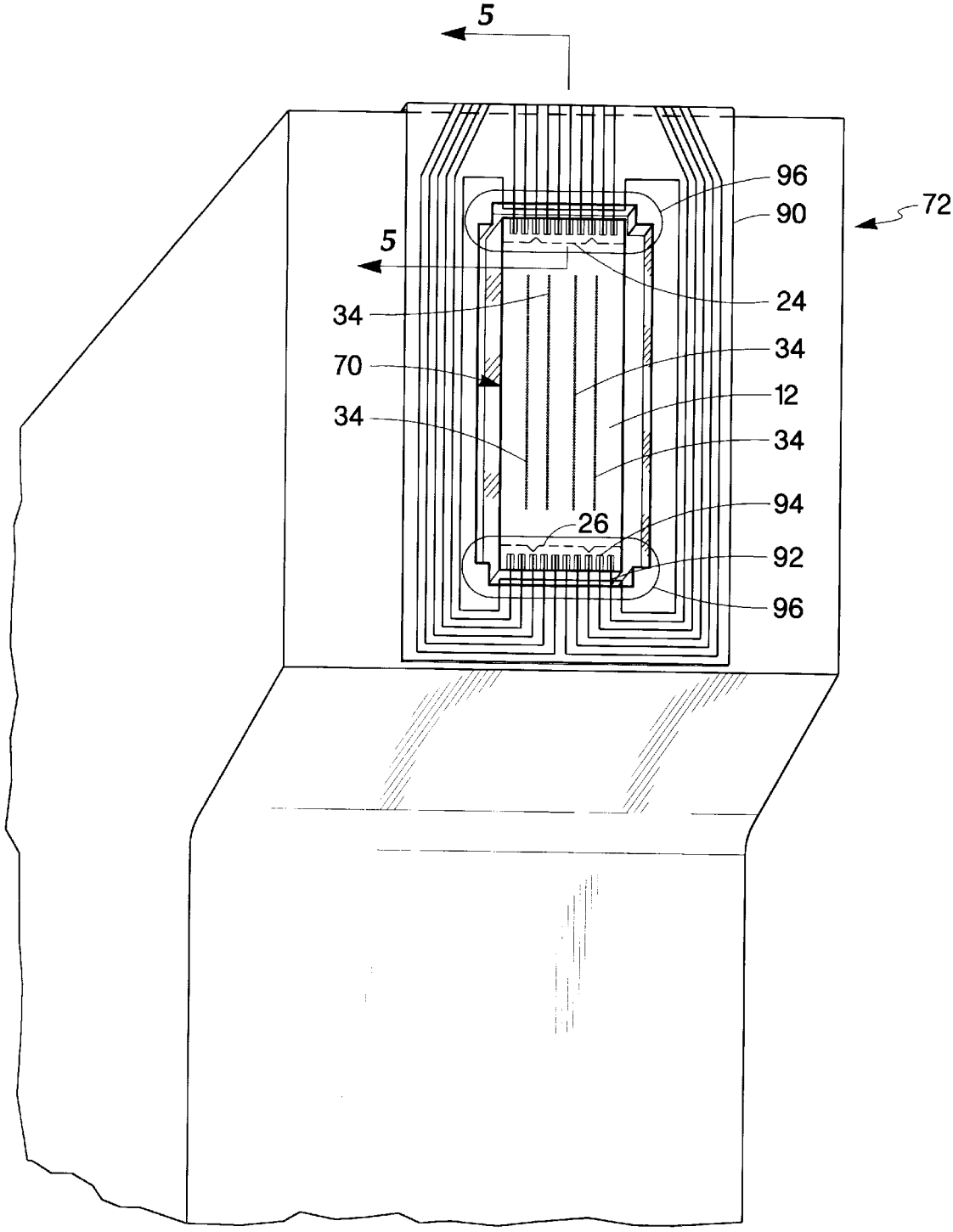
FIG. 4 is a perspective view of an ink jet (or fluid ejection) cartridge including an orifice plate according to the embodiment of FIG. 1.
Figure 5:
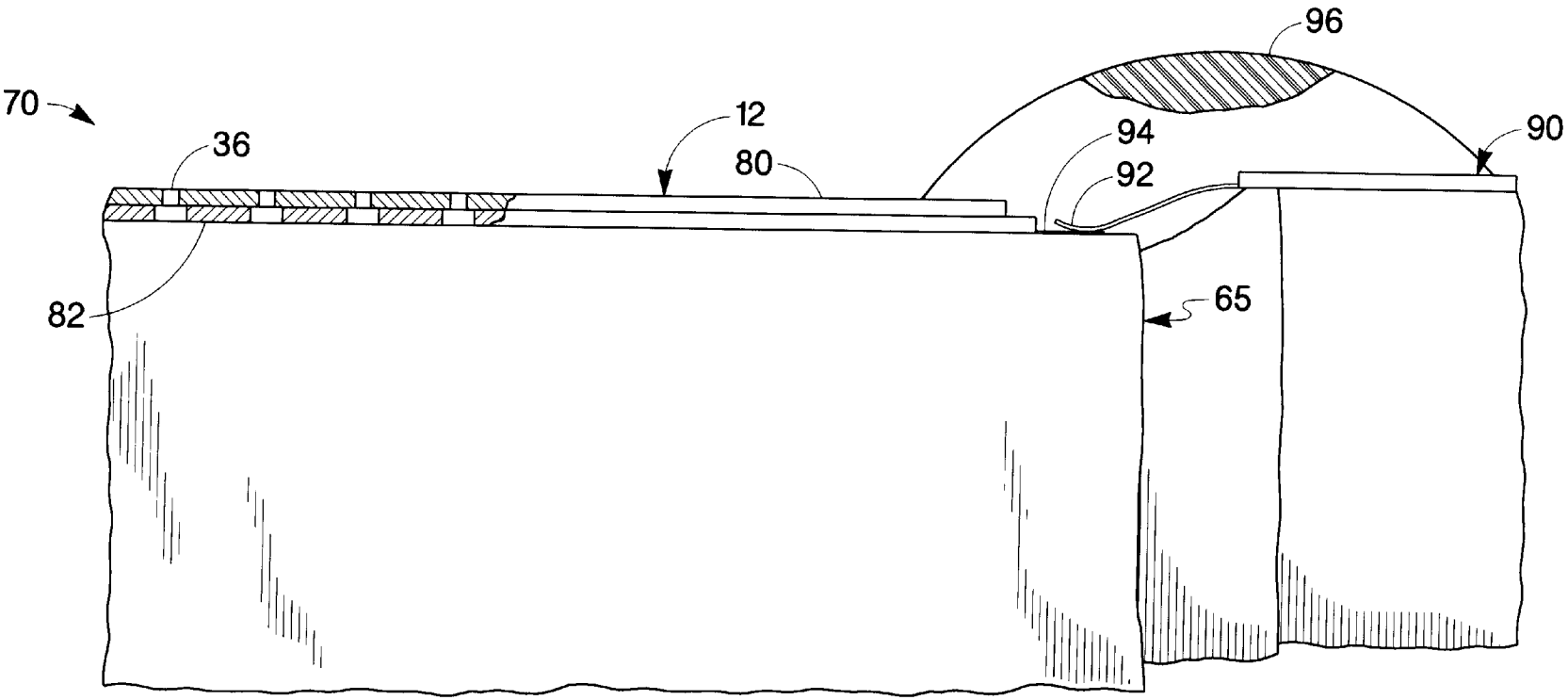
FIG. 5 is an enlarged schematic sectional view of the ink jet cartridge of FIG. 4, taken along section 5—5.

As shown in FIGS. 4 and 5, the singulated plate 12 is applied over a barrier layer 82. The barrier layer 82 defines firing chambers that each substantially align with and correspond to the orifices 36 in the plate. Under the barrier layer 82 is an integrated circuit 65 with arrays of resistors/heating elements corresponding to the firing chambers. The integrated circuit 65, together with the barrier layer and the orifice plate are part of a print head (or fluid ejection device) 70.

In the embodiment shown in FIG. 4, an inkjet cartridge body (or fluid ejection cartridge) 72 has a recessed area for receipt of the print head 70. In this embodiment, the print head 70 is bonded to the cartridge body 72 with structural adhesive. Fluid conduit(s) are located at a bottom of the recessed area. The conduit conveys one or more colors of fluid from fluid chambers within the cartridge into a slot in the print head 70. The slot is fluidically coupled with the firing chambers. In one embodiment, the barrier layer 82 acts a gasket to prevent fluid flow between adjacent orifices. The fluid is heated in the firing chambers by the resistors and expelled from the corresponding nozzle orifice 36.

As shown in FIGS. 4 and 5, along ends of the print head 70 are bond pads 94. In the embodiment shown, there are 19 bond pads along each end. A circuit element 90 includes conductive tabs 92 that extend to contact with the bond pads 94. The circuit element 90 electrically couples the print head with a printer.

In one embodiment, an insulating layer 96 is applied at each end of the print head. In a more particular embodiment, the insulating layer is a bead of encapsulant. In yet a more particular embodiment, the layer 96 is room temperature vulcanizing silicon rubber. In an alternative embodiment, the layer 96 is a low temperature curing epoxy-based material. In this embodiment, the insulating layer 96 protects elements that are covered from corrosion.

In the embodiment shown, the insulating layer 96 encapsulates the end surfaces 44 of the break tabs, the bond pad 94 and the conductive tabs 92. In one embodiment, the encapsulant covers the entire length of each end edge 24, 26, as well as extends onto the surface of the plate. The encapsulant extends at least partially into the end zone 56, described with regard to FIG. 2.

In the embodiment shown, having the break tabs along the end edges 24, 26 allows encapsulation of the break tabs with a margin of error: the length of the end zone 56. In this manner, encapsulation of the orifices 36 is substantially avoided. In another embodiment, the encapsulant extends over less than 300 $\mu$m onto the surface of the plate.

In one embodiment, the exposed end surface of the break tab is not encapsulated by the insulating layer 96. In this embodiment, the core plate material does not negatively react with some fluid chemistries to which the embodiment is exposed.

It is believed that the peak interfacial stresses between the printhead layers are reduced by the embodiments described herein, thereby improving pen reliability.

Although this invention has been described in certain specific embodiments, many additional modifications and variations will be apparent to those skilled in the art. For example, in an alternative embodiment (not shown), the sheet of orifice plates are not staggered (in the brick layout of FIG. 1), but are lined up in substantially straight rows and columns. In an alternative embodiment (not shown), the plates have break tabs along side edges in addition to or instead of along the shorter end edges. In another embodiment, the rows of orifice plates are staggered by other than half of the width of the orifice plate. In another embodiment, there are any number of break tabs along either the end edge or the side edge (from zero to a plurality of break tabs, an embodiment where a disjunction location is determined independently of the shape of the break tab, the shape of the break tab is any feasible shape.

Figure 3A:
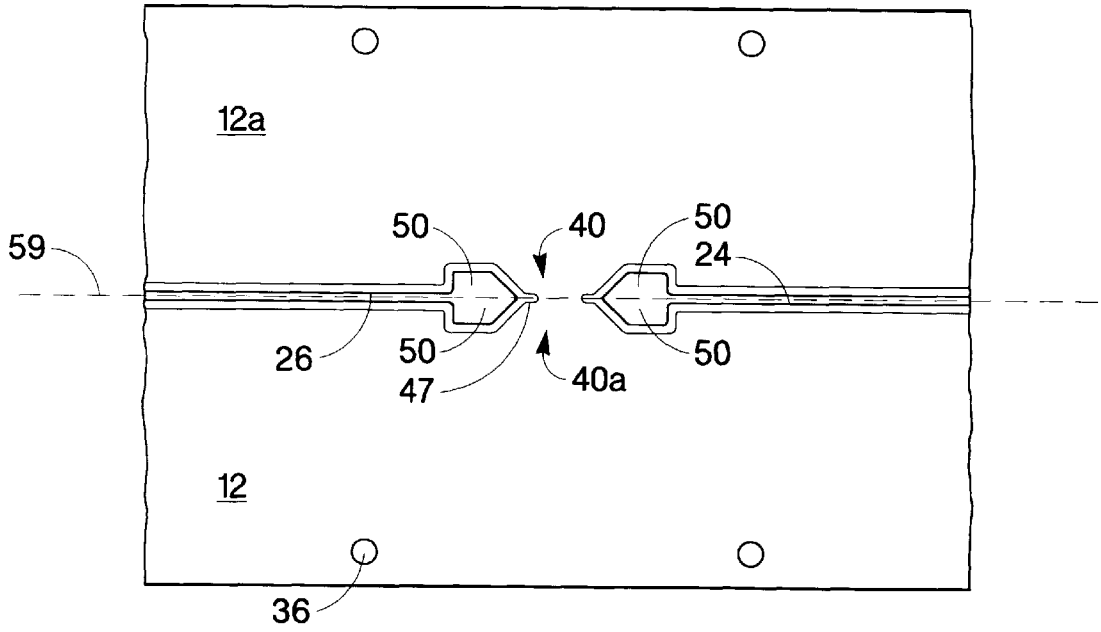
FIG. 3A is an enlarged view of section 3 of FIG. 2.
Figure 3B:
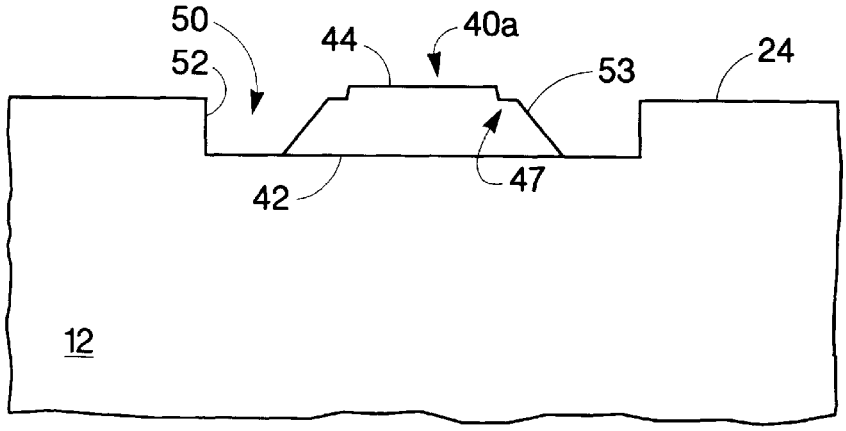
FIG. 3B is an enlarged view of the break tab 40*a* in FIG. 3A.

In the embodiment shown in FIG. 3A, the break tab 40*a* of plate 12 and the break tab 40 of the adjacent plate 12*a* are coupled when in a first position. FIG. 3B shows the break tab 40*a* in a second position, wherein the break tabs 40, 40*a* have been separated along break area 59, as described in more detail below.

As shown in the embodiment of FIG. 3A, along the end edge 24 (or 26) of each orifice plate are pairs of recesses 50. In between these adjacent pairs of recesses 50 are the break tabs 40. Each recess has a first side wall 52 adjacent the edge 24 of the plate 12, a second side wall 53 adjacent to and shared with the break tab 40, and a bottom in between the first and second side walls. In the embodiment shown, the break tab has substantially symmetrical side walls 53. The first side wall 52 is substantially perpendicular to the edge 24, 26 of the plate body.

As shown in FIGS. 3A and 3B, the break tab 40*a* has a base portion 42 that is defined by, aligned with, and/or corresponding to the bottoms of the pair of recesses. The base portion 42 of the break tab is about 320 $\mu$m to 500 $\mu$m long in between the pairs of recesses, depending upon the application. In the embodiment shown, the break tab 40*a* extends away from the bottom of the recesses, as the base portion 42 tapers to a nose portion (or end surface) 44. Accordingly, the base portion 42 is wider than the end surface 44. In an alternative embodiment (not shown), the break tab is substantially square in that the base portion 42 is the same width as the nose portion 44.

As shown in FIG. 3A, the break tab 40 of the adjacent plate 12*a* also has a nose portion/end surface that corresponds to the nose portion/end surface 44 of plate 12. The break line 59 is substantially along the end surfaces of the adjacent break tabs in the adjacent orifice plates. Each nose portion has a length of about 180 $\mu$m. At ends of the nose portions are notches (or notched sections) 47. These notched sections 47 are aligned with the break area 59.

As shown in FIG. 3*b,* in one embodiment, after the plates are singulated, end surfaces (or nose portions) 44 of the break tabs are exposed with the core depending upon the application). In yet another embodiment, the break tabs are in the corners of the plates as well as along the end edges of the plates.

It is therefore to be understood that this invention may be practiced otherwise than as specifically described. Thus, the present embodiments of the invention should be considered in all respects as illustrative and not restrictive, the scope of the invention to be indicated by the appended claims rather than the foregoing description.

What is claimed is:

1. An orifice plate of a fluid ejection device comprising:

a rectangular plate body having an edge and a plurality of nozzle arrays, wherein the edge has a pair of recesses therealong; and a break tab in between the pair of recesses along the edge.

2. The orifice plate of claim 1 wherein the break tab has an end surface that is substantially aligned with the edge of the plate body.

3. The orifice plate of claim 2 wherein the break tab has a base portion that is adjacent to and corresponds to bottoms of the pair of recesses.

4. The orifice plate of claim 3 wherein the break tab has substantially symmetrical side walls in between the base portion and the end surface.

5. The orifice plate of claim 4 wherein the base portion is wider than the end surface.

6. The orifice plate of claim 1 wherein the recess has a first side wall adjacent the edge of the plate body and a second side wall adjacent the break tab, wherein the first side wall is substantially perpendicular to the edge of the plate body.

7. A fluid ejection device comprising:

a plurality of heating elements; and a rectangular orifice plate defining an array of orifices through which heated fluid is ejected, each orifice associated with one of the heating elements, wherein the plate has an edge, wherein the edge has a pair of recesses therealong, and a break tab in between the pair of recesses along the edge.

8. The orifice plate of claim 7 wherein the break tab has an end surface that is substantially aligned with the edge of the plate body, wherein the break tab has a base portion that is wider than the end surface, wherein the base portion is adjacent to and corresponds to bottoms of the pair of recesses.

9. A method of manufacturing a fluid ejection cartridge comprising:

coupling a plate having a plurality of orifices to a fluid ejection device having a plurality of heating elements that correspond to the plurality of orifices, wherein the plate has an edge with a pair of recesses therealong, and a break tab in between the pair of recesses along the edge;

coupling the fluid ejection device to a cartridge body; and encapsulating the edge of the plate.

10. The method of claim 9 wherein the break tab has an end surface that is substantially aligned with the edge of the plate.

11. The method of claim 9 wherein the break tab has a base portion that is adjacent to and corresponds to bottoms of the pair of recesses.

12. A method of manufacturing a fluid ejection device comprising:

coupling a plate having a plurality of orifices to a fluid ejection device having a plurality of heating elements that correspond to the plurality of orifices, wherein the plate has an edge with a pair of recesses therealong, and a break tab in between the pair of recesses along the edge.

13. A method of manufacturing orifice plates comprising:

forming a sheet with a plurality of plates, wherein the plurality of plates includes a first plate, wherein the first plate has a plate body having a plurality of orifice arrays and an edge, wherein the edge has a pair of recesses therealong;

forming a plurality of break tabs in between adjacent plates, wherein the plurality of break tabs includes a first break tab along the edge of the first plate in between the pair of recesses; and singulating the plates along the break tabs.

14. The method of claim 13 further comprising exposing an end surface of the first break tab after singulating the plates, wherein the end surface is substantially aligned with the edge of the first plate.

15. The method of claim 13 wherein a laser singulation process is used in the singulation of the plates.

* * * * *